US011192142B1

(12) United States Patent
Cencich

(10) Patent No.: US 11,192,142 B1
(45) Date of Patent: Dec. 7, 2021

(54) MATERIAL HANDLING PROCESSING MACHINE HAVING INTERCHANGEABLE COMPONENTS FOR PROVIDING MULTI-FUNCTIONALITY

(71) Applicant: Whirlwind Engineering, Inc., Grand Rapids, MI (US)

(72) Inventor: Steven J. Cencich, Grand Rapids, MI (US)

(73) Assignee: Whirlwind Engineering, Inc., Grand Rapids, MI (US)

( * ) Notice: Subject to any disclaimer, the term of this patent is extended or adjusted under 35 U.S.C. 154(b) by 138 days.

(21) Appl. No.: 16/599,680

(22) Filed: Oct. 11, 2019

(51) Int. Cl.
*B07B 1/20* (2006.01)
*B07B 1/18* (2006.01)

(52) U.S. Cl.
CPC ..... *B07B 1/20* (2013.01); *B07B 1/185* (2013.01)

(58) Field of Classification Search
CPC .. B07B 1/20; B07B 1/185; A47J 43/06; A47J 43/22
See application file for complete search history.

(56) References Cited

U.S. PATENT DOCUMENTS

| | | | | |
|---|---|---|---|---|
| 2,710,098 | A * | 6/1955 | Tilton | A47J 44/02 209/358 |
| 2,735,531 | A * | 2/1956 | Spivey | A47J 43/22 193/2 R |
| 3,063,563 | A * | 11/1962 | Winchell | B07B 1/06 209/283 |
| 8,934,816 | B2 * | 1/2015 | Yamabe | G03G 15/0879 399/258 |
| 9,066,618 | B2 * | 6/2015 | Lim | A47J 19/025 |
| 9,675,101 | B2 * | 6/2017 | Conti | A47J 43/06 |
| 10,413,980 | B2 * | 9/2019 | Naughton | B23D 51/16 |
| 2020/0061629 | A1 * | 2/2020 | Breneman | A47J 42/34 |

* cited by examiner

*Primary Examiner* — Patrick H Mackey
(74) *Attorney, Agent, or Firm* — Frank M. Scutch, III

(57) ABSTRACT

A material handling machine includes a substantially cylindrical tub having an inlet and outlet where the tub includes a ring configured internally to the tub. A hopper is used for directing materials entering the inlet and a grate covers the inlet for controlling the amount of material into the tub. An impeller is rotated using a motor for processing material singulated by the impeller and a basket sifts material from the impeller. The impeller is supported by the main spindle such that the at least one impeller and basket are interchangeable depending on the type of material.

20 Claims, 8 Drawing Sheets

500

MATERIAL HANDLING PROCESSING MACHINE HAVING INTERCHANGEABLE COMPONENTS FOR PROVIDING MULTI-FUNCTIONALITY

FIELD OF THE INVENTION

The present invention relates generally to material handling machines and more particularly to a material handing machine with interchangeable internal components for providing multifunctionality.

BACKGROUND

Material handling machines are known in the art for processing various types of materials. In both commercial and industrial use, these machines often are very large enabling them to process various types of materials. One problem associated with these machines, is that often a separate machine is required for each type of material. Consequently, the user must purchase multiple machines at a high expense and alternate these machines in and out depending on need. Thus, the need exists to provide a single machine that can be used in multiple material handing environments.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
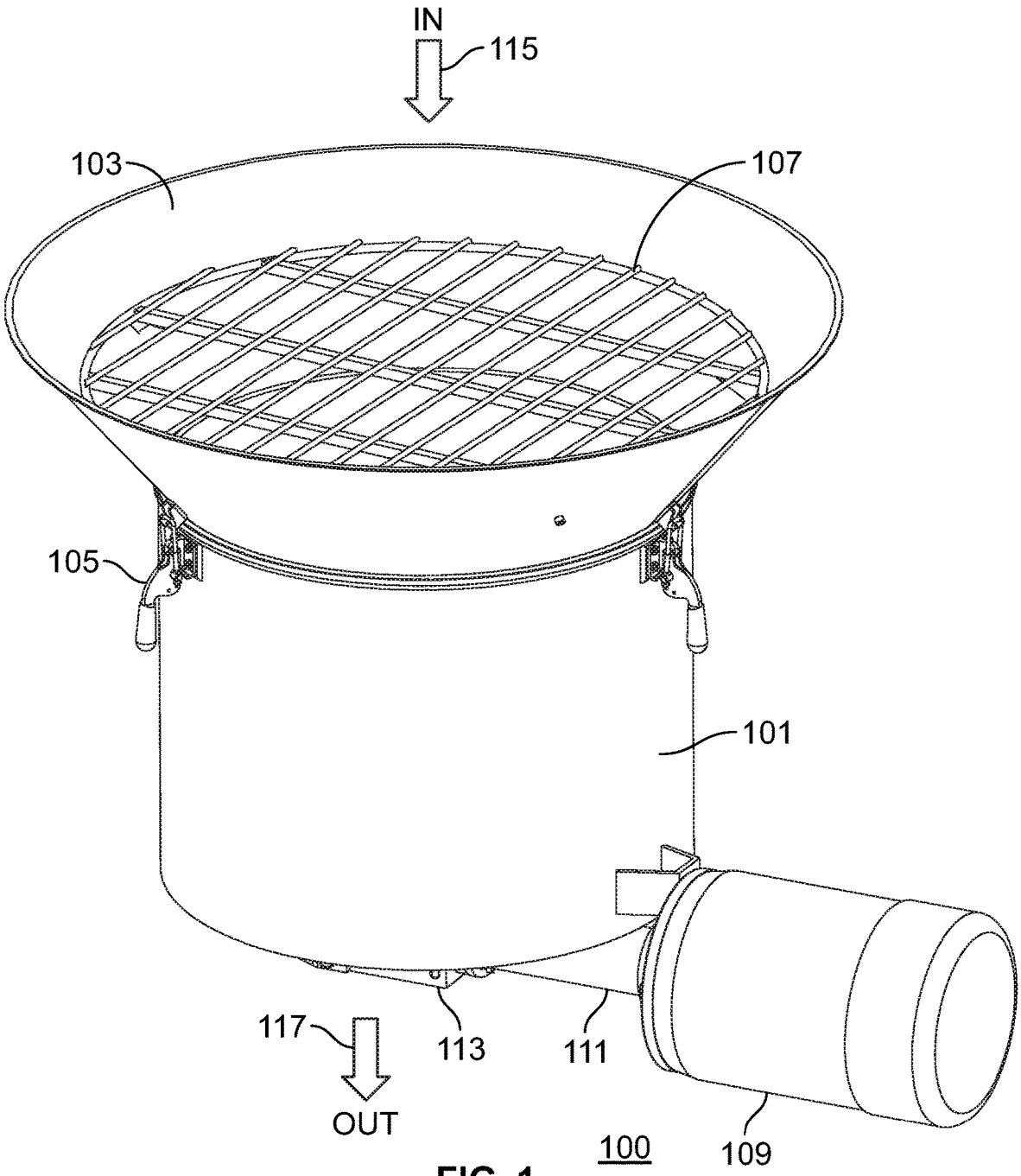
FIG. 1 is a perspective view of the material handing machine housing in accordance with an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a material handling machine having interchangeable components. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element. It is expected that one of ordinary skill, notwithstanding possibly significant effort and many design choices motivated by, for example, available time, current technology, and economic considerations, when guided by the concepts and principles disclosed herein will be readily capable of practicing the invention with minimal experimentation.

FIG. 1 is a perspective view of the material handing machine tub in accordance with an embodiment of the invention. The material handling machine 100 includes a housing or tub 101 where a loading hopper 103 is fastened to the tub 101 using one or more clamps 105. A safety grate 107 is positioned inside the loading hopper 103 for preventing large objects from being dropped into the hopper. A motor 109 is configured below the tub 101 where a drive shaft extends though a drive housing 111 to a gear box 113. The motor spins at approximately 1750 rpm and the energy from the spinning drive shaft is used by the gearbox 113 to drive a main spindle positioned substantially orthogonally to the drive shaft. As will be described herein, the main spindle spins in a range of approximately 0 to 500 rpm. Those skilled in the art will recognize that food and other materials may be processed by inserting the materials as seen by the "in" arrow 115 where they are processed within the machine 100 an exit below the tub 101 by the "out" arrow 117.

Figure 2:
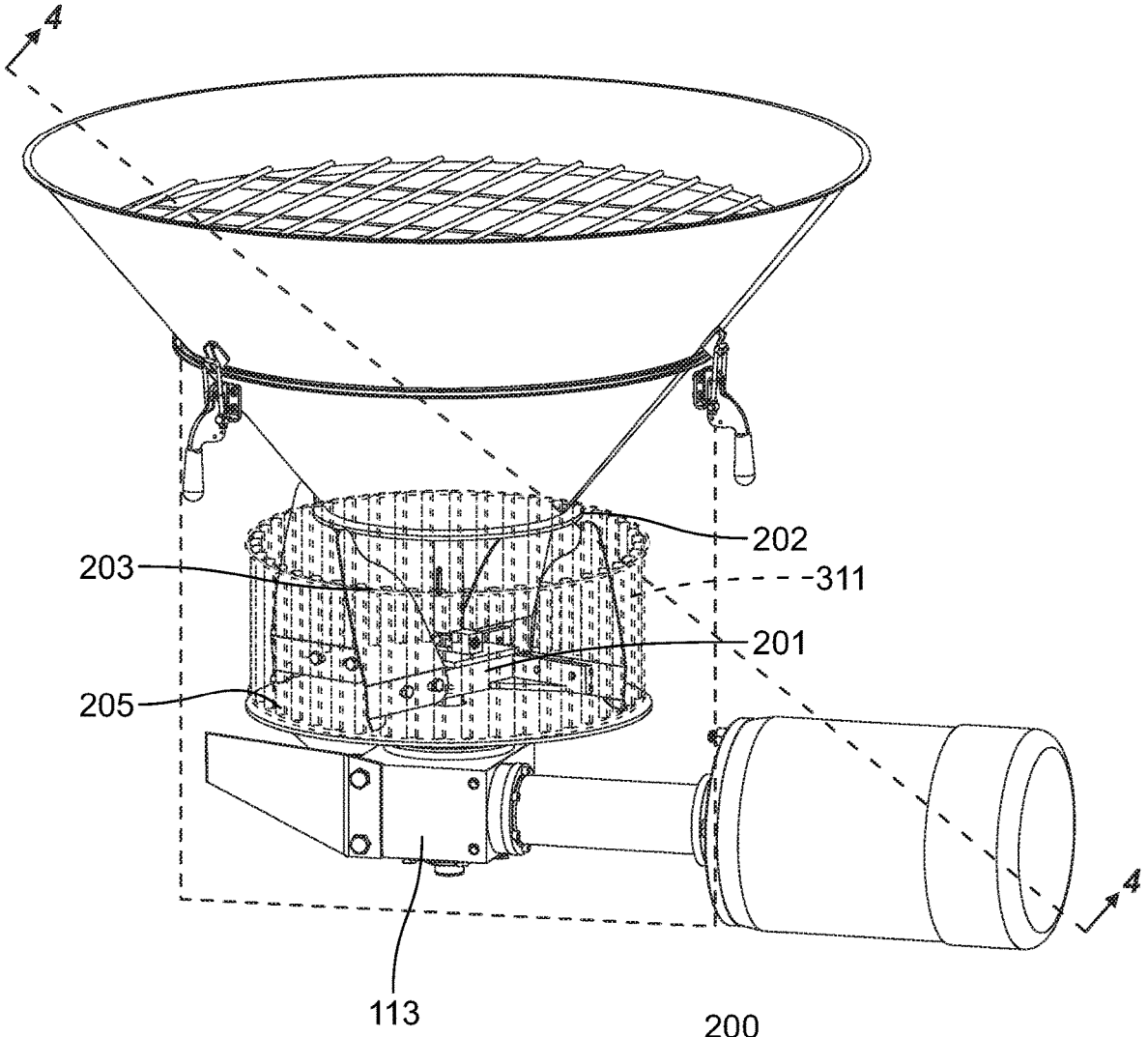
FIG. 2 is a perspective view of the powder sifter installed in the material handling machine tub.

FIG. 2 is a perspective view of the powder sifter installed in the material handling machine tub. The powder sifter 200 is illustrated with the gearbox 113 rotating a standard impeller 201. Materials contact a feed plate 202 before contacting the impeller 201. The impeller 201, used for powdered materials, includes at least four blades 203 that are mounted to extend substantially vertically from a sieve basket bottom 205. In use, the rotating impeller 201 will break up clumped granular products and powders. For example, when salt might agglomerate together due to moisture in a mass, the impeller 201 will break the mass allowing the salt or other granular product to be sifted and then ejected through the bottom of the powder sifter 200 from tub 207 in a granular form.

Figure 3:
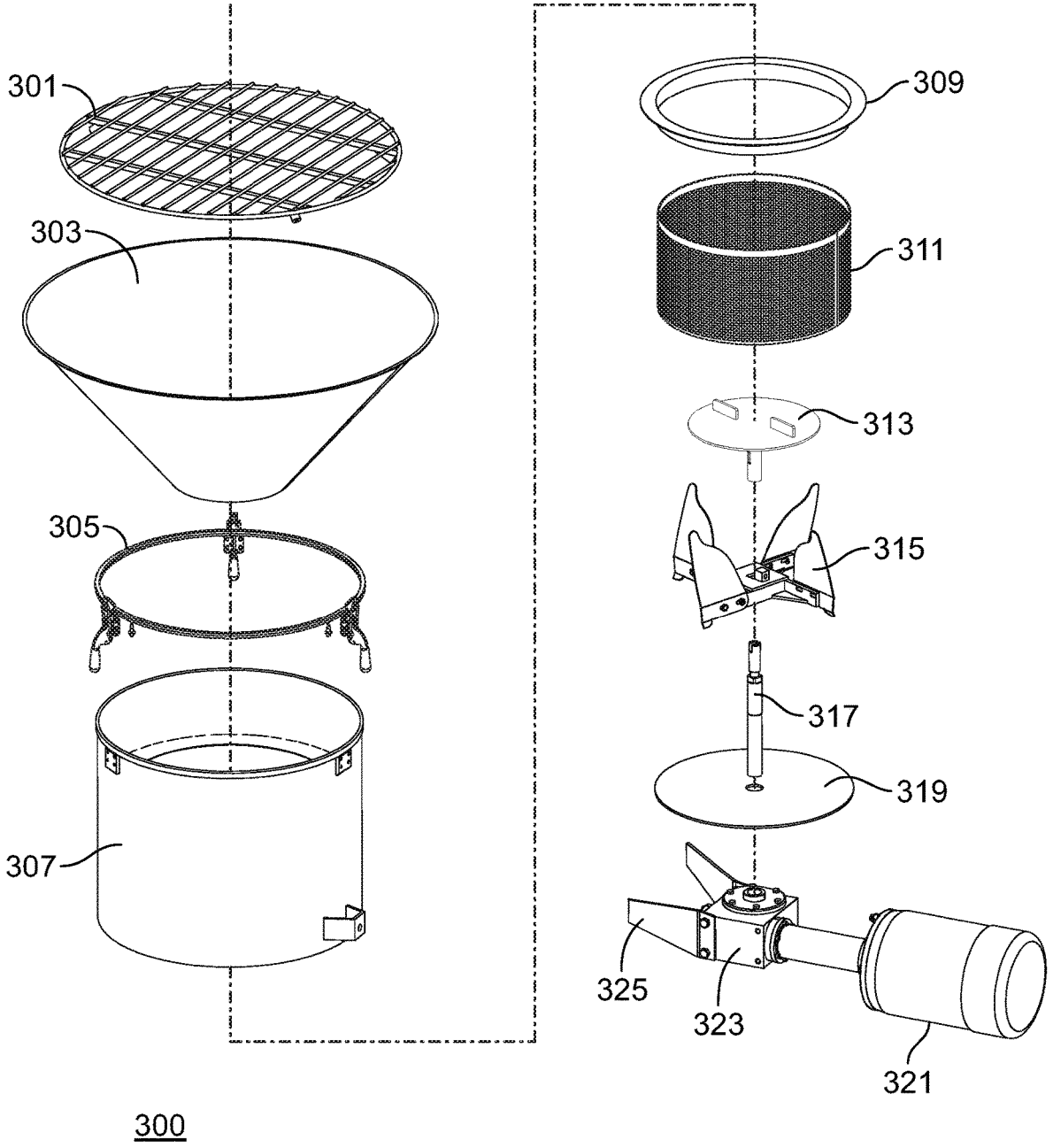
FIG. 3 is an exploded view of the powder sifter shown in FIG. 2.

FIG. 3 is an exploded view of the powder sifter shown in FIG. 2. The powder sifter 300 includes a safety grate 301 positioned within a hopper 303. A lip ring 305 is configured at the top of the tub 307 which enables the tub 307 to be mechanically fastened to the hopper 303. Inside the tub 307, an angle ring 309 is positioned about a mesh 311. The mesh 311 is an open cylindrical structure where the holes in the mesh 311 are configured and/or sized based on the material being processed. As seen in FIG. 3, the basket bottom 319 is configured at the bottom of the mesh 313 and provides support for this assembly. Those skilled in the art will recognize that the angle ring 309, mesh 311 and base bottom 319 can be joined as a single weldment. In an alternative embodiment, the feed plate 313 can be configured into a nibbler feed plate. The nibbler feed plate includes a plurality of nibblers that are typically figured to extend vertically across the surface of the feed plate which helps to further break up material for processing. Although FIG. 3 shows only two breaker bars, other figurations are also possible. For example, three arms having three nibblers each can be configured to extend from the center of the feed plate in a trilateral configuration to aid in chopping more heavily clumped materials.

Inside the mesh 311, a standard impeller 315 rotates at a substantially high speed to throw material though the mesh 311. Although the standard impeller 315 is illustrated with four tapered blades, those skilled in the art will recognize that different blade configurations and sizes are possible depending on the materials being processed. The standard impeller 315 is rotated using a main spindle 317 such that the spindle 317 extends orthogonally from the surface of the basket bottom 319 which is a substantially round plate. A motor 321 and gear box 323 work to rotate the standard impeller 315 and main spindle 317 at a substantially high rate so as to process materials though the machine. One or more mounts 325 work to attach the gear box 323 with the tub 307.

Figure 4:
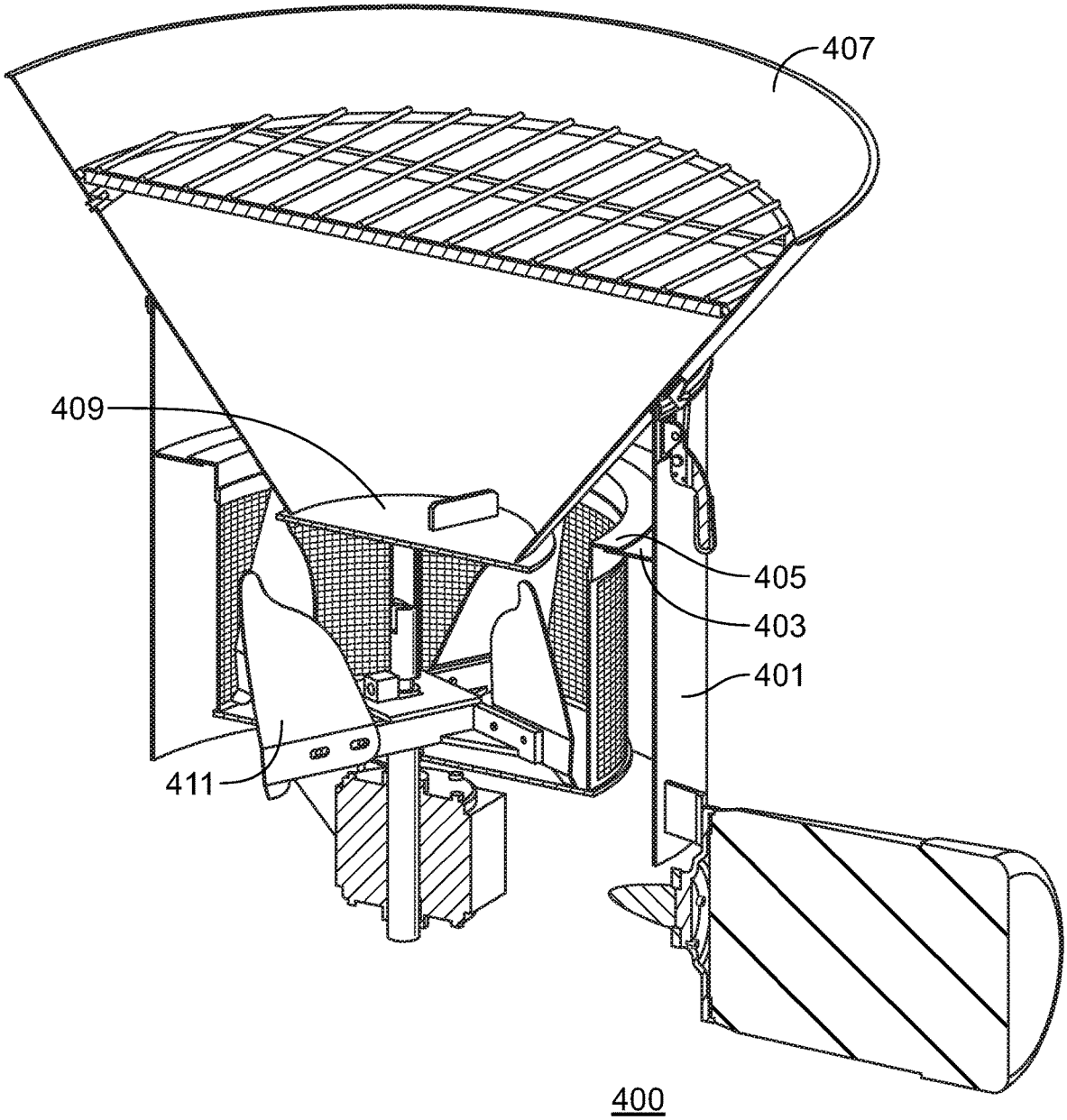
FIG. 4 is a cross-sectional view of the power sifter shown in FIG. 2.

FIG. 4 is a cross-sectional view of the power sifter taken though lines -IV shown in FIG. 2. The material handling machine 400 is illustrated where the tub 401 includes a tub ring 403 the extends internally about the upper perimeter of the tub 401. In use, the internal components can be easily interchanged within the tub depending on the types of material being processed. As seen in the FIG. 4, the angle ring 405 is configured to fit over the tub ring 403 where they are fastened together using pins or other types of mechanical fasteners. The weight of the internal components attached to the angle ring 405 holding the angle ring 405 to the tub ring 403. In use, food or other materials that are placed into the hopper 407 contact the rotating feed plate 409 where they are sifted and then fall toward the rotating impeller 411. Thereafter they are further sifted through the mesh 413.

The sifted material such as a powder then falls though the tub 401 where it is ejected from the bottom of the tub 401. Those skilled in the art will recognize an important feature of the invention is the interchangeability of components inside the tub 401. Since various configurations of components can be used with an angle ring 405, the material handling capabilities of one machine can easily be interchanged changed or reconfigured in the tub 401, by lifting out one set of components in the tub 401 for another. The new components and angle ring 405 will fit directly into the tub ring 403 through the use of fastening pins or the like. This allows the industrial consumer to use only one machine preventing the necessity to purchase multiple machines for differing material handling needs.

Figure 5:
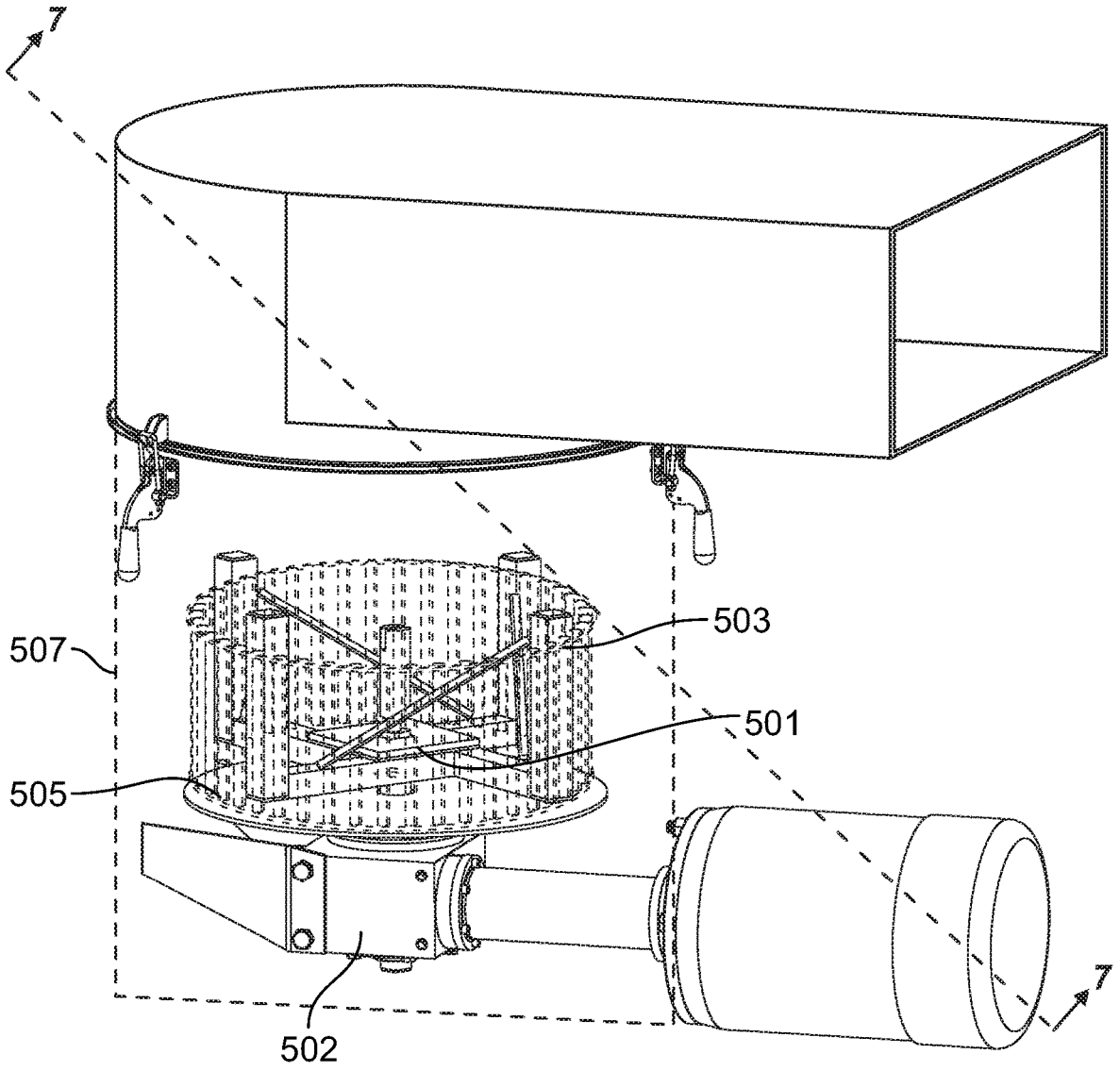
FIG. 5 is a perspective view of the declumper machine.

FIG. 5 is a perspective view of the declumper installed in the material handling machine tub. The declumper 500 is illustrated with the gearbox 502 rotates a tubular impeller 501. The tubular impeller 501 is used for declumping food materials and includes at least four tubular blades 503 extending vertically from and unattached to the basket bottom. In use, the rotating impeller 501 will break up bunched or clumped products. For example, when dried fruit, which is sticky, might bunch together in a mass. The tubular impeller 501 will break the mass allowing the fruit to be broken up and declumped. It is ejected through the bottom of the declumper 500 from tub 507 in the declumped form.

Figure 6:
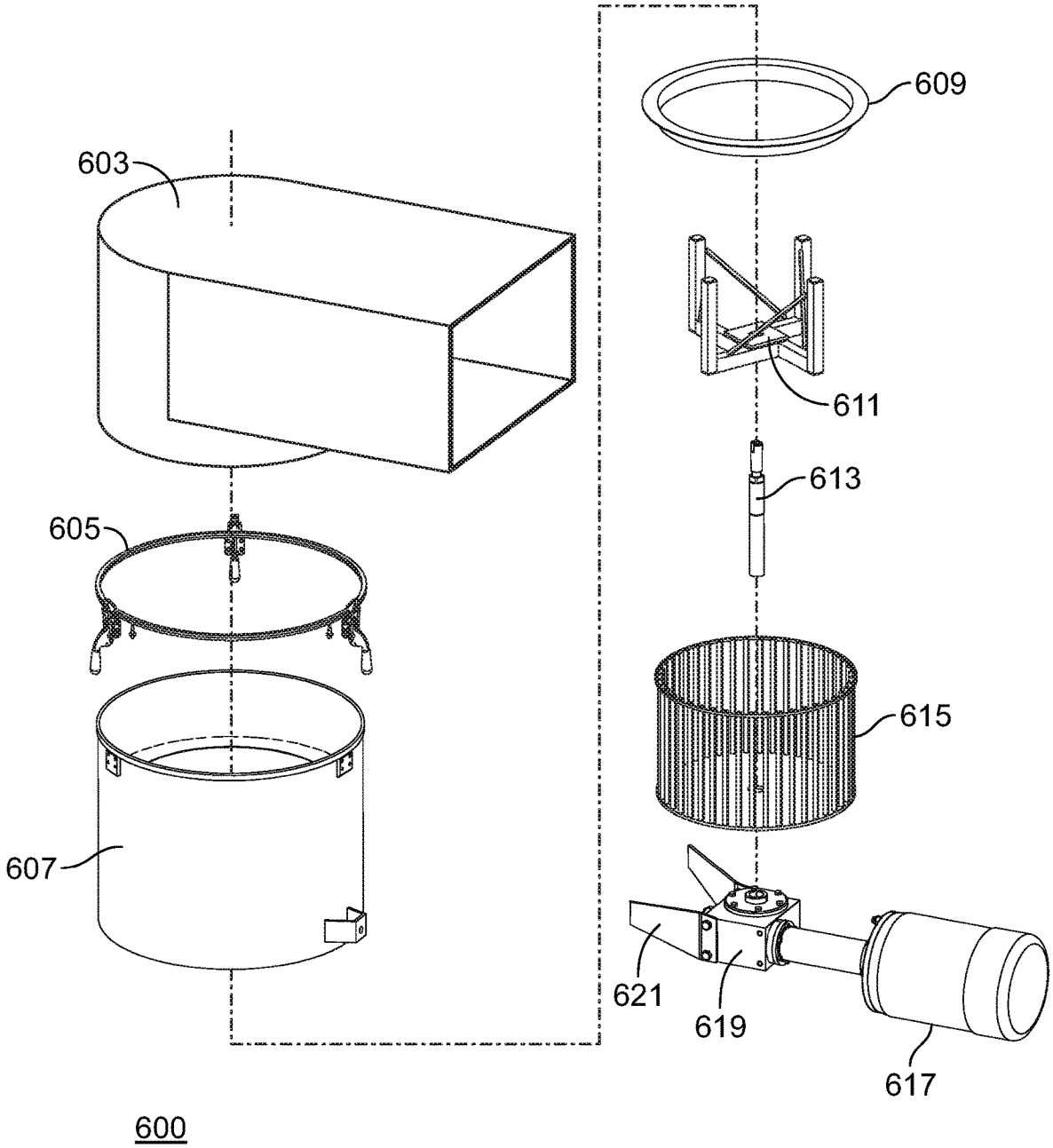
FIG. 6 is an exploded view of the declumper machine shown in FIG. 5.

FIG. 6 is an exploded view of the declumper shown in FIG. 5. The declumper 600 includes a block style loading hopper 603. A lip ring 605 is configured near the upper edge of the tub 607 which enables the tub 607 to be mechanically fastened to the hopper 603. Inside the tub 607, an angle ring 609 is used to hold the internal components into position. Further, a tubular impeller 611 rotates at a substantially high speed to push material though a vertical bar basket 615. Although the tubular impeller 611 is illustrated with four tubular blades, those skilled in the art will recognize that different blade configurations and sizes are possible depending on the materials being processed. The tubular impeller 611 is rotated using a main spindle 613. The spindle 613 extends orthogonally from a gear box 619 that translates energy from motor 617. The motor 617 and gear box 619 work to rotate the tubular impeller 611 and main spindle 613 at a substantially high rate so to process clumped materials though the machine. One or more mounts 621 work to attach the gear box 619 with the tub 607.

Figure 7:
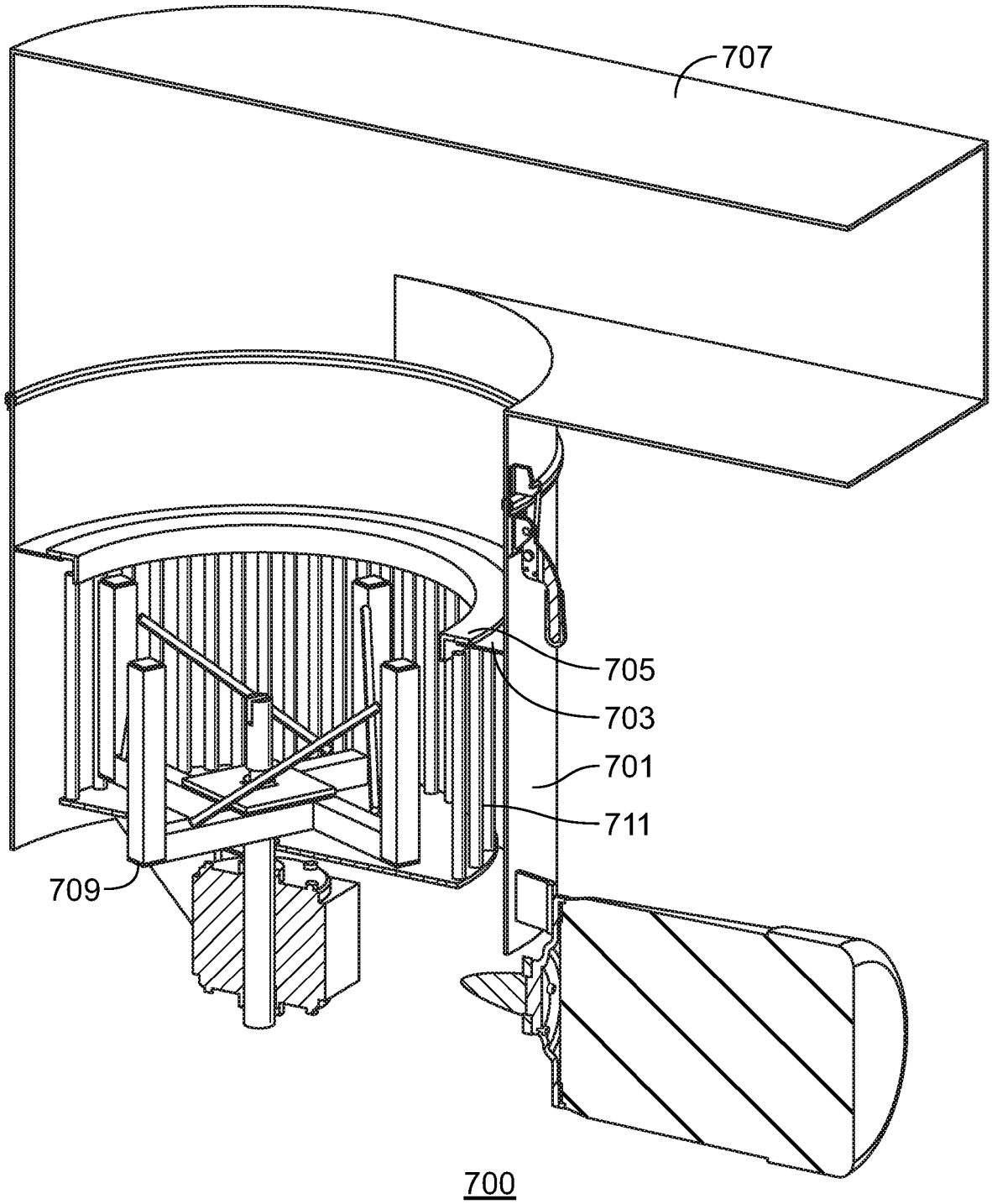
FIG. 7 is a cross-sectional view of the declumper shown in FIG. 5.

FIG. 7 is a cross-sectional view of the declumper taken though lines VII-VII shown in FIG. 5. The material handling machine 700 is illustrated where the tub 701 includes a tub ring 703 the extends internally about the upper perimeter of the tub 701. In use, the internal components can be easily switched, substituted, replaced and/or interchanged within the tub depending on the types of material being processed. As seen in the FIG. 7, the angle ring 705 is configured to fit over the tub ring 703 where they are fastened together using pins or other types of mechanical fasteners. The weight of the internal components attached to the angle ring 705 hold the angle ring 705 to the tub ring 703. In use, food or other materials that are placed into the hopper 707 which contact the rotating impeller 709. The material is declumped and/or singulated through the vertical bar basket 711. Those skilled in the art will recognize the singulating means the act or process of separating conjoined material into individual or "single" parts or pieces. The singulating process involves separating typically food products or pharmaceuticals into individual units from larger conjoined batches. Alternatively, a rotating feed plate can be used to pre-condition incoming material and control feed rate into the vertical bar basket 711.

Thereafter, the processed material, such as clumped fruit or the like, falls though the tub 701 where it is ejected for use. As noted herein, the declumper as described herein can be easily interchanged into the tub 701 though the use of the angle ring 705 and tub ring 703. If another material handling arrangement is required, the declumper can be easily removed from its secure position over the tub ring 703 and replaced with another type of machine e.g. the powder sifter, that might be needed for a particular application. This allows the industrial consumer a great amount of versatility since multiple machines do not have to be purchased, set-up and/or exchanged each time different types of material handling processes are required.

Figure 8:
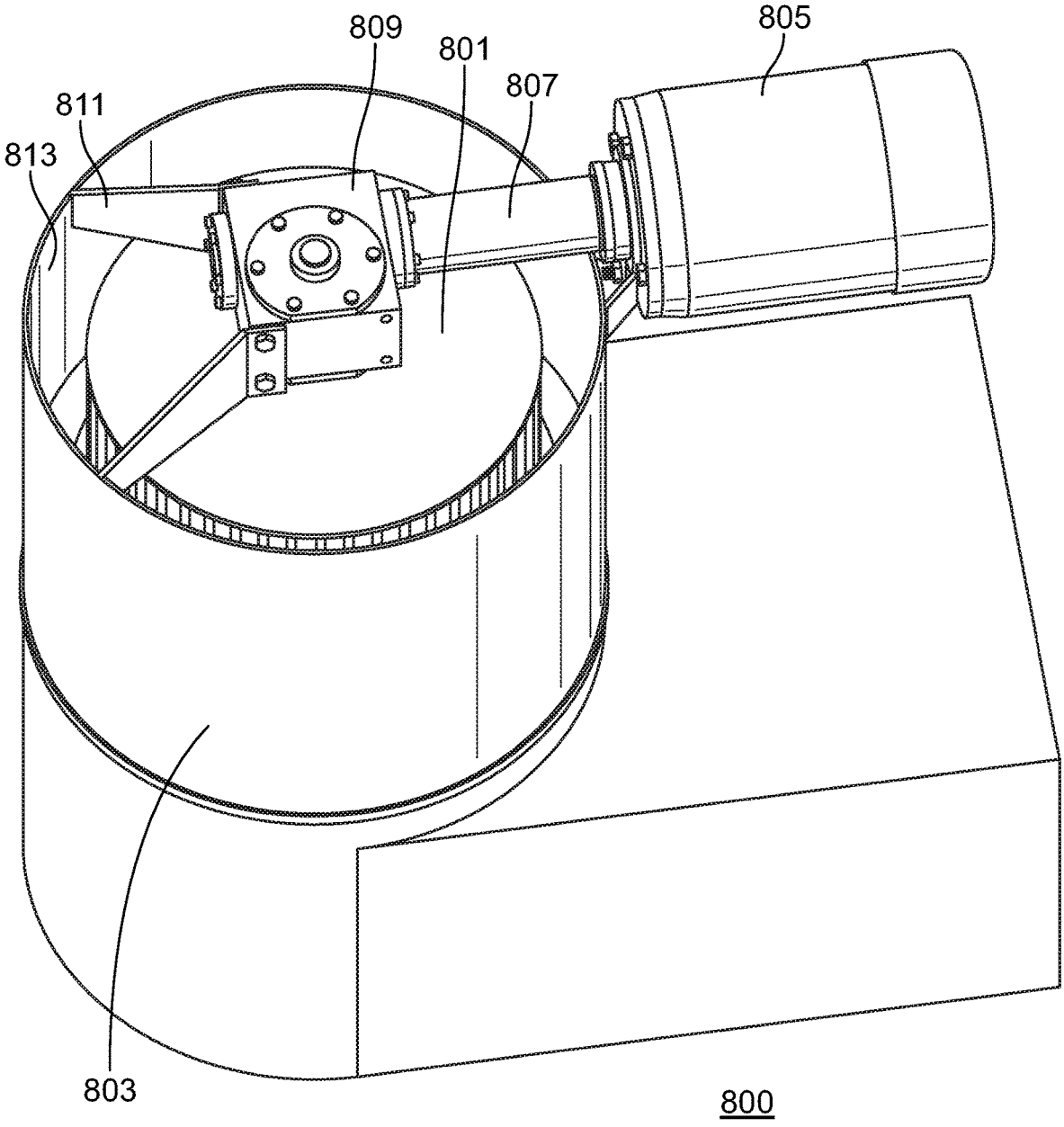
FIG. 8 is a bottom perspective view of the declumper.

FIG. 8 is a bottom perspective view of the declumper illustrating the drive mechanism. The declumper 800 is shown where the vertical bar basket 801 is configured in a fixed position within the tub 803. The motor 805 drives a shaft 807 to the gearbox 809. The gearbox 809 is fastened to the interior of the tub 803 using one or more mounts 811. As material such as clumped foods are moved though the vertical bar basket 801, they will exit though the gap annular 813 in a declumped form where they can be collected in a bucket, bowl or conveying system.

Thus, the present invention is directed to a material handling machine having interchangeable components for processing different types of materials. The machine uses a tub having an inlet and outlet that are substantially linearly aligned. A hopper is for directing material to the inlet and a selectable impeller is used for singulating, chopping and/or sifting material entering the hopper. A sieve or basket is used for filtering processed material from the impeller. A motor and spindle rotate the impeller. The material handling machine is unique in that it includes an interior ring within the basket allowing differing types of components to be interchanged depending a desired sifting or declumping processes required for various types of materials.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. A material handling machine comprising:

a cylindrical tub having an inlet and outlet where the tub includes a ring configured internally to the tub for supporting a hopper for directing materials entering the inlet;

a grate covering the inlet;

at least one impeller rotated using a motor for processing material by the impeller;

a basket having a plurality of vertical slats for singulating clumped material from the at least one impeller; and wherein the at least one impeller is supported by a shaft such that the at least one impeller and basket are interchangeable depending on the type of material.

2. A material handling machine as in claim 1, wherein the at least one impeller includes a plurality of tapered blades for sifting powder.

3. A material handling machine as in claim 1, wherein the at least one impeller includes a plurality of vertical blades for declumping material.

4. A material handling machine as in claim 3, wherein the plurality of vertical blades are tubes.

5. A material handling machine as in claim 1, wherein the basket is meshed screen.

6. A material handling machine as in claim 1, wherein the inlet and outlet are linearly aligned.

7. A material handling machine as in claim 1, wherein the basket is perforated metal.

8. A material handling machine having interchangeable components for processing different types of materials comprising:

a tub having an inlet and outlet where a basket within the tub has a plurality of vertical slats for filtering declumped material;

a hopper for directing material to the inlet;

at least one impeller for processing material entering the hopper;

a sieve for filtering processed material from the at least one impeller;

a motor and spindle for rotating the at least one impeller; and wherein the input and outlet are linearly aligned such that material entering at one end of the tub exit at the opposite end of the tub.

9. A material handling machine as in claim 8, further comprising a feed plate rotating with and configured above the at least one impeller for directing materials to the at least one impeller.

10. A material handling machine as in claim 8, further comprising a gearbox for translating rotating motion form the motor orthogonally to the spindle.

11. A material handling machine as in claim 8, wherein the at least one impeller and sieve are interchangeable for use in different types of materials.

12. A material handling machine as in claim 8, wherein the at least one impeller includes a plurality of tapered blades for sifting powder.

13. A material handling machine as in claim 8, wherein the at least one impeller includes a plurality of vertical blades for declumping material.

14. A material handling machine as in claim 13, wherein the plurality of vertical blades are tubes.

15. A material handling machine as in claim 8, wherein the sieve is a basket formed using meshed screen.

16. A material handling machine as in claim 8, wherein the sieve is a basket using a plurality of vertical slats for filtering declumped material.

17. A material processor comprising:

an enclosure having an ingress at one end of the enclosure through which material is received into the enclosure and a discharge at the opposite end of the enclosure through which material is removed from the enclosure;

a hopper for directing material into the ingress;

a spindle rotatably mounted within the enclosure, the spindle having a longitudinal spindle axis about which the spindle rotates;

a motor operatively connected with the enclosure and rotating the spindle using a gearbox for orthogonally translating motion from the motor to the spindle;

an impeller rotated by the motor for processing the material from the hopper where the impeller includes a plurality of tubes for declumping the material;

a basket acting as a sieve, the sieve sifting material from the ingress and providing sifted material to the discharge; and wherein the impeller and basket are interchangeable allowing for processing differing types of materials.

18. A material processor as in claim 17, wherein the impeller includes a plurality of tapered blades for sifting powder.

19. A material processor as in claim 17, wherein the basket includes a plurality of vertical slats for filtering declumped material.

20. A material handling machine as in claim 8, wherein the sieve is a basket formed using perforated metal.

* * * * *